US005829896A

United States Patent [19]

Cain, Jr.

[11] Patent Number: 5,829,896

[45] Date of Patent: Nov. 3, 1998

[54] KEYCAP SPRING INSTALLATION TOOL

[76] Inventor: Gerald K. Cain, Jr., 2606 Brenda Dr., Mesquite, Tex. 75149

[21] Appl. No.: 58,108

[22] Filed: Apr. 9, 1998

[51] Int. Cl.[6] ..... B25B 27/30

[52] U.S. Cl. ..... 400/491.2; 29/227; 29/280

[58] Field of Search ..... 400/491.2, 491.3; 29/225, 227, 228, 270, 278, 280

[56] References Cited

U.S. PATENT DOCUMENTS

| | | | |
|---|---|---|---|
| 1,843,866 | 2/1932 | Chapman | 29/227 X |
| 3,162,938 | 12/1964 | Koeller | 29/227 X |
| 4,330,916 | 5/1982 | Dannatt | 29/227 X |
| 4,845,827 | 7/1989 | Vandermast et al. | 29/280 X |

*Primary Examiner*—Edgar Burr
*Assistant Examiner*—Minh Chau
*Attorney, Agent, or Firm*—Steven W. Smith

[57] ABSTRACT

A device and method for installing a keycap spring in a computer keyboard having a vertical tube and a base for mounting the keycap spring at the bottom of the vertical tube. The device comprises a handle, a shaft with a tapered head connected to the handle, a sleeve which slides over the shaft, and a sleeve spring connected to the sleeve which slides over the shaft and fits between the sleeve and the handle. The keycap spring is inserted into the sleeve where it fits over the tapered head of the shaft. The tool is then inserted into the vertical tube and the end of the tool is placed over the base. Downward pressure is then applied to the tool, causing the keycap spring to be compressed inside the sleeve. When the keycap spring is fully compressed, the downward pressure applied by the user forces the bottom end of the keycap spring onto the base. The tool is then extracted. The keycap spring is held by the base, causing the spring to slide out of the sleeve.

19 Claims, 3 Drawing Sheets

KEYCAP SPRING INSTALLATION TOOL

BACKGROUND OF THE INVENTION

1. Technical Field of the Invention

This invention relates to hand tools and, more particularly, to a hand tool for installing keycap springs in a computer keyboard.

2. Description of Related Art

Computer keyboards are commonly utilized as input devices for interfacing with a computer such as a personal computer (PC). The keyboards have a plurality of keys which are depressed in a downward direction by the user to input data to the computer. Each of the keys has a keycap with an identification of the function of the key printed thereon, and a shaft which extends downward where it ultimately makes an electrical contact when the key is depressed by the user. Each key also has associated with it, a mechanism for returning the key to the raised position after it is depressed by the user. In some keyboards (for example IBM keyboards), the mechanism for returning the key to the raised position is a keycap spring.

FIG. 1 is an exploded perspective view of a cutaway section of a typical keyboard which utilizes keycap springs for retuning the keys to the raised position. Two key assemblies are illustrated. Each assembly comprises a keycap 11, a key stem 12, a keycap spring 13, and a vertical tube 14 which may be mounted to the top surface of a strike plate 15. Below the strike plate, in the interior of the keyboard enclosure, is a circuit board 16 which converts the keystrokes into electrical signals to the computer when struck by the key stem 12. Mounted on the circuit board below each key are small bases 17 to which the keycap springs 13 attach.

When the key assembly is installed, the top of the keycap spring rests inside the key stem 12. The keycap spring passes through the vertical tube 14, and the bottom of the keycap spring is mounted on the base 17. As the key is depressed by the user, the keycap spring compresses. However, the keycap spring is unstable in this condition, and is not laterally supported. When the key has been depressed far enough to make electrical contact with the circuit board, the keycap spring suddenly loses lateral stability, and the center of the spring rapidly moves in a lateral direction and strikes the side of the vertical tube. To the user, this causes a clicking sound and tactile feedback through the key indicating that the key has been depressed far enough to make electrical contact.

FIG. 2 is a side elevational view of an exemplary base 17 to which the keycap spring attaches in existing keyboards. The base may be conical in shape or may include a generally conical top portion 18 and a small cylindrical bottom portion 19, as shown. The diameter of the cylindrical bottom portion is slightly larger than the inside diameter of the keycap spring. In an existing method of attaching the keycap spring 13 to the base 17, a technician first inserts the spring into the vertical tube 14. The bottom end of the spring must then be moved so that it overlies the base. Then, utilizing a tool such as a small screwdriver, the technician attempts to push the bottom loop of the spring onto the cylindrical portion of the base. The technician must manipulate the screwdriver so that the tip moves around the circumference of the bottom loop of the spring and pushes the spring onto the base in several positions around the circumference. Sufficient downward force must be exerted on the spring to expand the bottom loop to fit tightly around the cylindrical portion of the base. When the spring is correctly installed, it is held securely on the base, with the spring standing at an angle that places the top of the spring in the center of the tube 14.

From the foregoing description of the key assembly and the existing procedure for installing keycap springs, it can be seen that the procedure is tedious, tiring, and time consuming. If a large number of keycap springs are to be installed, these problems are amplified. There are no known prior art teachings of a solution to the aforementioned deficiencies and shortcomings such as that disclosed herein. In order to overcome the disadvantage of the existing method, it would be advantageous to have a device and method for installing keycap springs in a computer keyboard which simplifies the installation process and eliminates the tedious and tiring procedure of pressing the bottom loop of the spring onto the base with a screwdriver. The present invention provides such a device and method.

SUMMARY OF THE INVENTION

In one aspect, the present invention is a keycap spring installation tool for installing a keycap spring with a bottom loop on a base in a computer keyboard. The tool comprises means for holding the keycap spring, and means for exerting downward pressure on the keycap spring sufficient to expand the bottom loop of the spring over the base.

In another aspect, the present invention is a device for installing in a computer keyboard, a keycap spring having an inside diameter and an outside diameter. The device includes a handle and a shaft connected to the handle. The shaft comprises a main portion having a first diameter, and a head portion at an outside end of the shaft away from the handle, the head portion having a second diameter smaller than the first diameter and sized to fit snugly within the inside diameter of the keycap spring. The device also includes a sleeve which slides over the shaft, the sleeve having an inside diameter that fits over the outside diameter of the keycap spring. Finally, the device includes compressible means mounted between an inside end of the sleeve and the handle for allowing the sleeve to slide toward the handle.

In yet another aspect, the present invention is a method of installing a keycap spring in a computer keyboard having a vertical tube and a base for mounting the keycap spring at the bottom of the vertical tube. The method utilizes a device comprising a handle, a shaft with a tapered head connected to the handle, a sleeve which slides over the shaft, and a sleeve spring connected to the sleeve which slides over the shaft and fits between the sleeve and the handle. The keycap spring is inserted into the sleeve where it fits over the tapered head of the shaft. The tool is then inserted into the vertical tube and the end of the tool is placed over the base. Downward pressure is then applied to the tool, causing the keycap spring to be compressed inside the sleeve. When the keycap spring is fully compressed, the downward pressure applied by the user forces the bottom end of the keycap spring onto the base. The tool is then extracted. The keycap spring is held by the base, causing the spring to slide out of the sleeve.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

Figure 1:
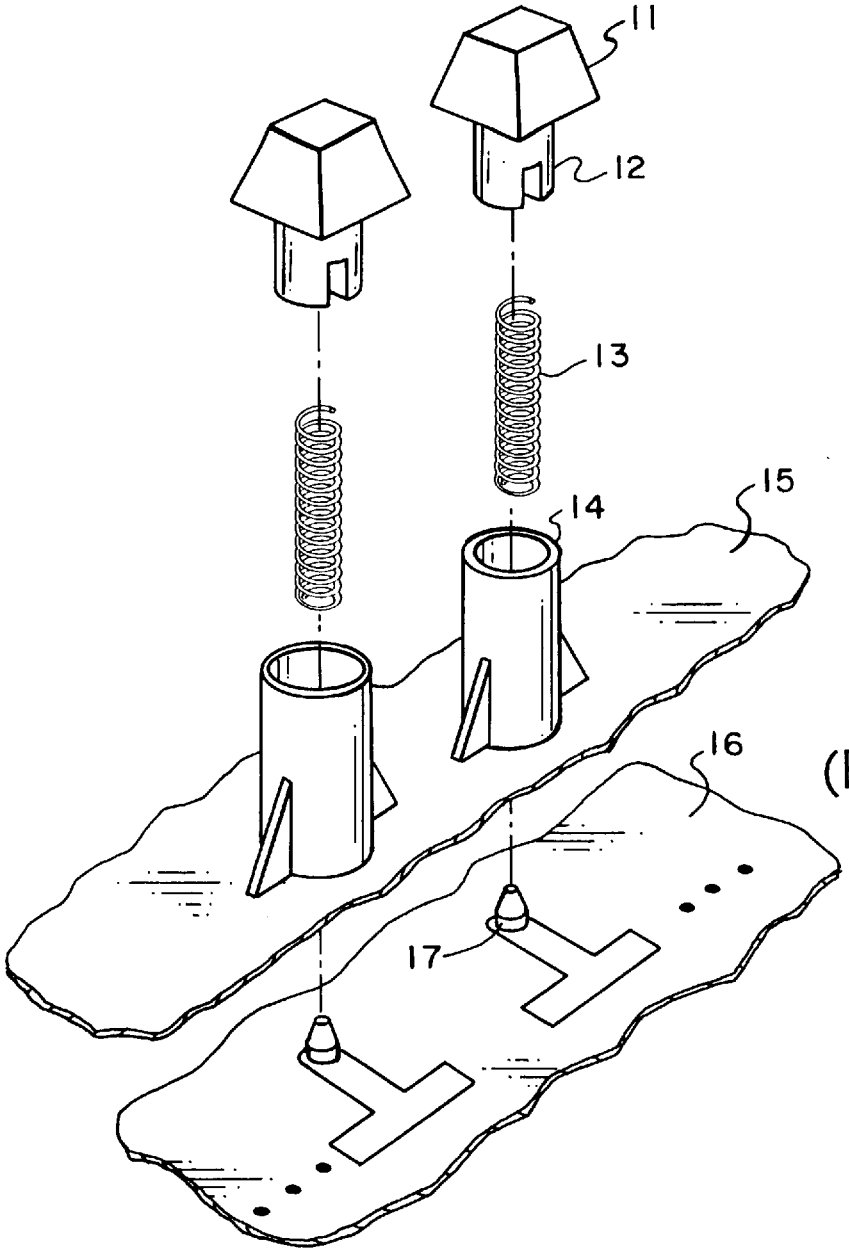
FIG. 1 (PRIOR ART)
FIG. 1 (Prior Art) is an exploded perspective view of a cutaway section of a typical keyboard which utilizes keycap springs for returning the keys to the raised position.
Figure 2:
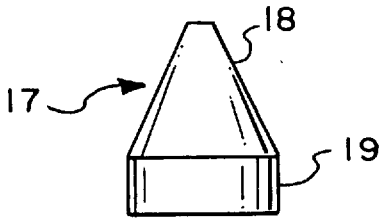
FIG. 2 (PRIOR ART)
FIG. 2 (Prior Art) is a side elevational view of a base to which the keycap spring attaches in existing keyboards.
Figure 3:
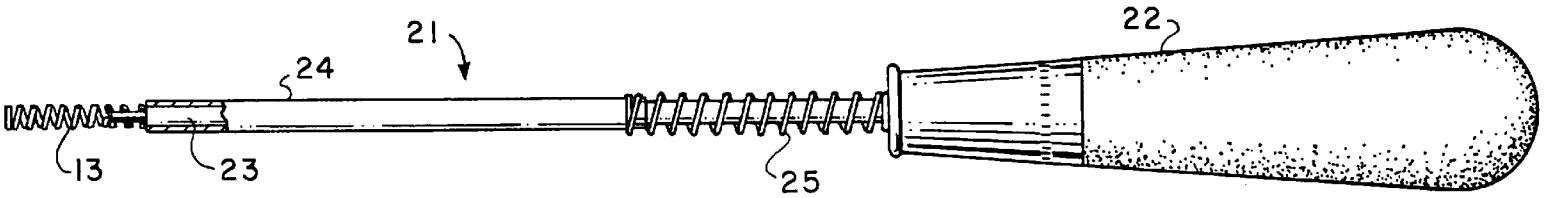
FIG. 3 is a partial cut-away plan view of the preferred embodiment of the keycap spring installation tool of the present invention, with the outward end of a sleeve cut away to show the head of a shaft and a loaded keycap spring.
Figure 4:
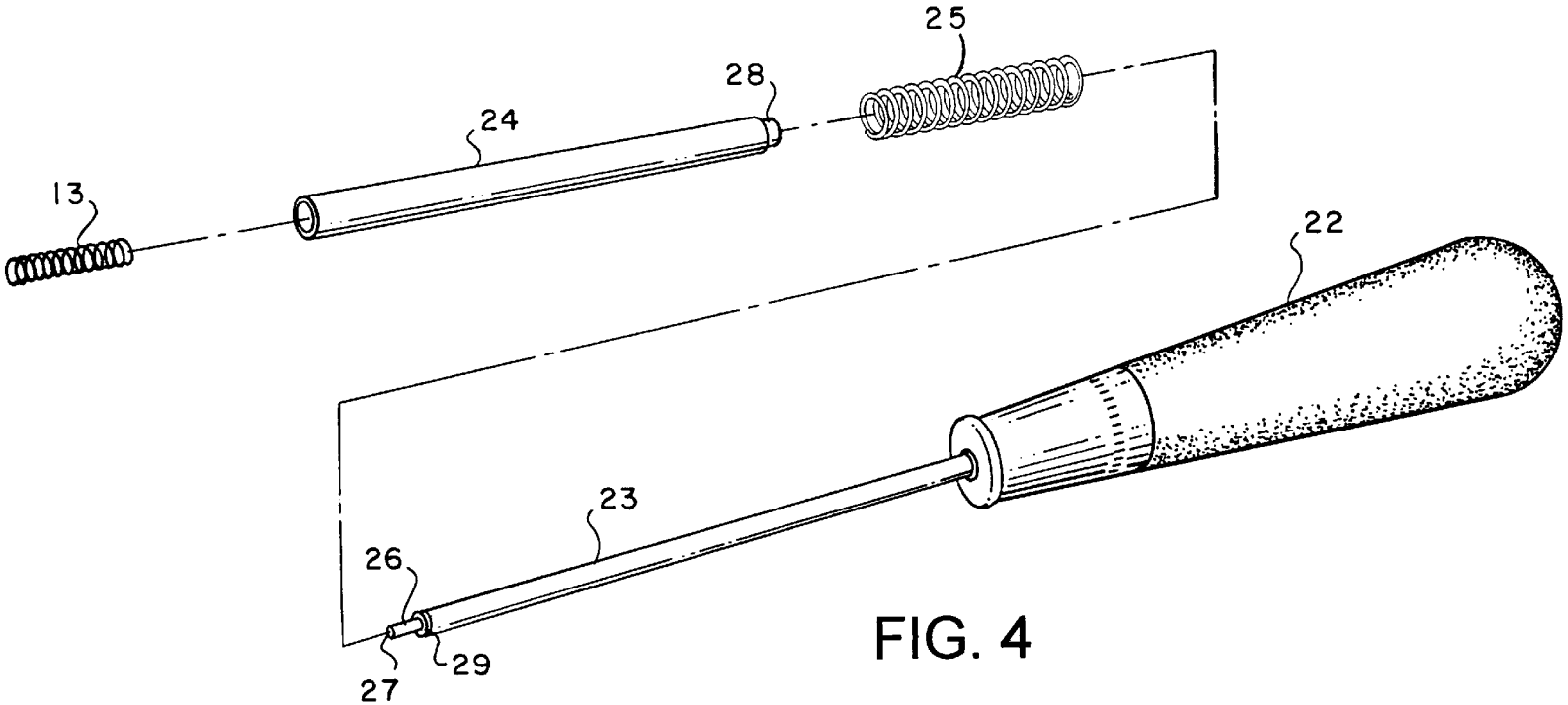
FIG. 4 is an exploded perspective view of a first embodiment of the keycap spring installation tool.

FIG. 3 is a plan view of the preferred embodiment of the keycap spring installation tool 21 of the present invention, with the outward end of a sleeve cut away to show the head of a shaft 24 and a loaded keycap spring 13. FIG. 4 is an exploded perspective view of a first embodiment of the keycap spring installation tool of FIG. 3. With reference to FIGS. 3 and 4, the tool will now be described.

The tool comprises a handle 22, a shaft 23, a sleeve 24, and a sleeve spring 25. The handle may be generally in the shape of a screwdriver handle, a "T" handle, or any other shape which is suitable for holding in the hand. The shaft includes a main portion and a head 26 at the end of the shaft, the head having a smaller diameter which is tapered at the tip 27. The tip may be rounded, blunt, or pointed. The sleeve spring 25 has an inside diameter slightly larger than the diameter of the shaft 23, allowing the sleeve spring to slide onto the shaft. The sleeve also has an inside diameter slightly larger than the diameter of the shaft 23, allowing the sleeve to slide onto the shaft after the sleeve spring.

The sleeve may be connected to the sleeve spring by any conventional method which does not interfere with the action of the spring or the ability of the connected sleeve and sleeve spring to slide onto the shaft. For example, FIG. 4 shows a shoulder 28 on the sleeve. The outside end of the sleeve spring fits snugly over the area of reduced outside diameter next to the shoulder. This allows the sleeve to be slid down the shaft toward the handle, thus compressing the sleeve spring, without having the sleeve spring slide on the outside of the sleeve past the shoulder. Alternatively, a circular groove may be cut in the outside surface of the sleeve near the inside end. The outside end of the sleeve spring may then be stretched over the inside end of the sleeve, allowing the end loop of the spring to fall into the groove. Once again, this allows the sleeve to be slid down the shaft toward the handle, thus compressing the sleeve spring, without having the sleeve spring slide on the outside of the sleeve past the groove.

The sleeve spring 25 is held in place either by attaching the back end of the sleeve spring to the handle by any suitable means, or by squeezing the back end of the spring to a smaller diameter so that it securely grips the shaft 24 when the sleeve spring is slid onto the shaft. It should be understood that although a sleeve spring has been shown in the preferred embodiment, any compressible elastomeric material or device may be utilized which allows the sleeve to slide toward the handle a distance approximately equal to the uncompressed length of the keycap spring.

The lengths and diameters of the shaft 23, the head 26, the sleeve 24, and the sleeve spring 25 are configured to hold and install a standard keycap spring 13. The inside diameter of the sleeve is slightly larger than the outside diameter of the keycap spring so that the sleeve conforms loosely around the keycap spring when the spring is inserted into the sleeve. The end of the keycap spring which is inserted into the sleeve then fits snugly over the head 26 and rests against a shoulder 29 of the shaft 23. The tapered tip 27 assists in directing the spring over the head as the spring is being inserted. The keycap spring is approximately ¾ inch long in its uncompressed state. In addition, the distance from the outside end of the sleeve to the shoulder 29 is also approximately ¾ inch when the sleeve spring 25 is in its uncompressed state. Therefore, when the keycap spring is inserted into the sleeve, the outside end of the spring is flush with the outside end of the sleeve.

As noted above, the keycap spring 13 fits snugly over the head 26 when it is inserted into the sleeve 24. This prevents the keycap spring from falling out when the tool 21 is held in a vertical position with the head pointing down. Alternatively, the keycap spring may be held in the sleeve by a magnetized shaft 23, with or without a head 26. When installing a keycap spring on a base 17, the forward end of the tool (with a keycap spring loaded in the sleeve) is inserted into the vertical tube 14 and the end of the tool is placed over the base 17. Downward pressure is then applied to the tool by the user. This pressure causes the sleeve 24 to slide up the shaft 23, compressing the sleeve spring 25. Simultaneously, the keycap spring 13 is compressed inside the sleeve as the head of the shaft moves downward. The conforming fit of the keycap spring within the sleeve provides lateral stability to the keycap spring, enabling the spring to be filly compressed without losing lateral stability. Once the keycap spring is fully compressed, the downward pressure applied by the user forces the bottom end of the keycap spring onto the base 17. The angle of the tool may be rotated slightly by the user to ensure that the keycap spring is properly seated on the base around the entire circumference of the spring.

When the keycap spring is fully compressed, the length of the keycap spring is approximately 5/16 inch. In addition, the base 17 on which the keycap spring is being mounted is approximately ⅛ inch high. During the installation process, the head 26 of the shaft extends through the center of the keycap spring directly over the base 17. Thus, the length of the head plus the height of the base cannot exceed the length of the fully compressed keycap spring. Therefore, the maximum length of the head 26 is approximately 3/16 inch in order to provide clearance between the tip 27 of the head and the ⅛-inch base when the keycap spring is fully compressed to its 5/16-inch length.

Once the keycap spring 13 is installed on the base 17, the tool 21 is extracted. The keycap spring is held by the base, causing the spring to slide out of the sleeve. If it is found at that point that the upper end of the keycap spring is not in the center of the tube 14, the user merely slides the sleeve over the installed keycap spring, compresses the spring a second time, and applies slight pressure in the direction that the spring needs to be reoriented. The tool is then extracted from the properly installed keycap spring.

Figure 5:
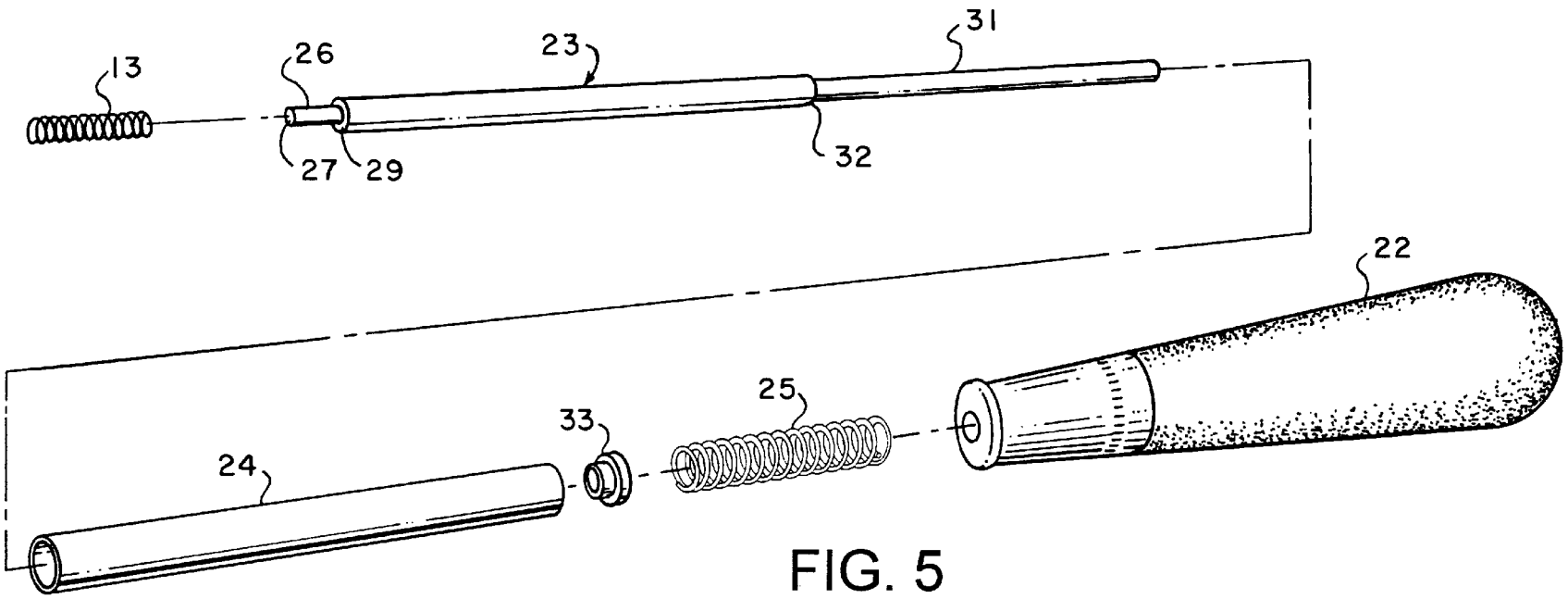
FIG. 5 is an exploded perspective view of a second embodiment of the keycap spring installation tool.

FIG. 5 is an exploded perspective view of a second embodiment of the keycap spring installation tool in which the range of movement of the sleeve 24 is restricted so that a user cannot inadvertently pull the sleeve completely off the shaft 23. In this embodiment, the shaft has an area of reduced diameter 31 which extends from the handle 22 to a point just past the inside end of the sleeve when the sleeve spring 25 is in its uncompressed state. This creates a step-like discontinuity 32 in the shaft diameter where the shaft diameter enlarges under the sleeve. In addition, the sleeve has a lip formed at the inside end of the sleeve which extends inward toward the shaft. The lip may be formed by press fitting a bushing 33 into the inside end of the sleeve. The inside diameter of the bushing is sized so that the bushing does not contact the reduced-diameter portion 31 of the shaft, but catches on the step-like discontinuity 32 where the shaft diameter enlarges. This stops the movement of the sleeve toward the head 26 of the shaft During manufacture, the sleeve 24, bushing 33, and sleeve spring 25 are slid onto the reduced-diameter portion 31 of the shaft from the inside end before the shaft is installed in the handle 22.

Figure 6:
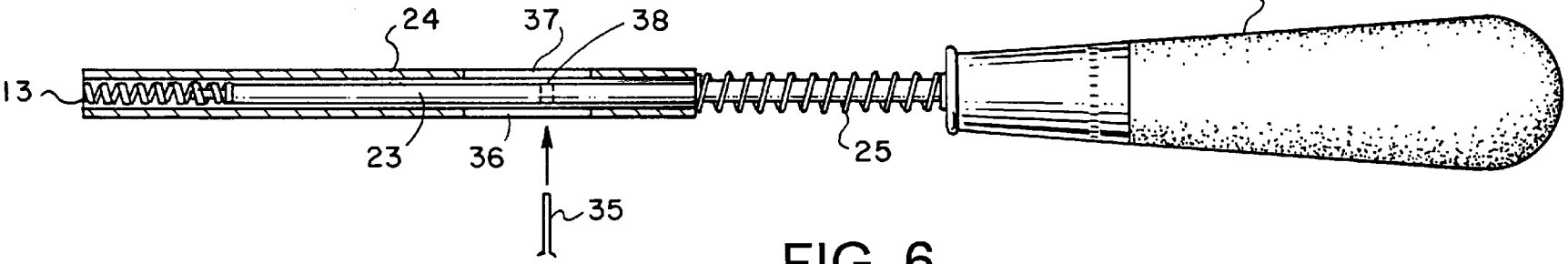
FIG. 6 is a partial cross-sectional plan view of a third embodiment of the keycap spring installation tool.

FIG. 6 is a partial cross-sectional plan view of a third embodiment of the keycap spring installation tool. In this embodiment, the range of movement of the sleeve 24 is restricted by placing a small cotter pin 35 through two slits 36 and 37 in opposite sides of the sleeve 24 and through a small transverse hole 38 in the shaft 23. The slits are approximately ¾ inch long, the length of the uncompressed keycap spring 13. The slits are positioned to allow the sleeve to slide backward toward the handle 22, thereby compressing the sleeve spring 25 while preventing the sleeve from sliding forward off the head 26 of the shaft when the cotter pin contacts the end of the slits.

It is thus believed that the operation and construction of the present invention will be apparent from the foregoing description. While the method and apparatus shown and described has been characterized as being preferred, it will be readily apparent that various changes and modifications could be made therein without departing from the scope of the invention.

What is claimed is:

1. A device for installing a keycap spring in a computer keyboard, said keycap spring having an inside diameter and an outside diameter, said device comprising:

a handle;

a shaft connected to the handle, said shaft comprising:

a main portion having a first diameter; and a head portion at an outside end of the shaft away from the handle, the head portion having a second diameter smaller than the first diameter and sized to fit snugly within the inside diameter of the keycap spring;

a sleeve which slides over the shaft, said sleeve having an inside diameter that fits over the outside diameter of the keycap spring; and compressible means mounted between an inside end of the sleeve and the handle for allowing the sleeve to slide toward the handle.

2. The device for installing a keycap spring of claim 1 wherein the computer keyboard has a base on which the keycap spring is installed, the base having a height, and the keycap spring has an uncompressed length and a compressed length, and the head portion of the shaft has a length which is less than the compressed length of the keycap spring minus the height of the base.

3. The device for installing a keycap spring of claim 2 wherein the compressible means for allowing the sleeve to slide toward the handle allows the sleeve to slide a distance approximately equal to the uncompressed length of the keycap spring.

4. The device for installing a keycap spring of claim 2 wherein the compressible means for allowing the sleeve to slide toward the handle is a sleeve spring mounted over the shaft between the inside end of the sleeve and the handle.

5. The device for installing a keycap spring of claim 4 wherein the sleeve spring has an uncompressed length which places an outside end of the sleeve a distance past the main portion of the shaft approximately equal to the uncompressed length of the keycap spring.

6. The device for installing a keycap spring of claim 4 further comprising means for retaining the sleeve on the shaft.

7. The device for installing a keycap spring of claim 6 wherein the means for retaining the sleeve on the shaft includes:

means for connecting the sleeve to the sleeve spring; and means for connecting the sleeve spring to the shaft adjacent to the handle.

8. The device for installing a keycap spring of claim 6 wherein the means for retaining the sleeve on the shaft includes:

means for connecting the sleeve to the sleeve spring; and means for connecting the sleeve spring to the handle.

9. The device for installing a keycap spring of claim 8 wherein the means for connecting the sleeve to the sleeve spring includes means for preventing the sleeve spring from sliding over the sleeve.

10. The device for installing a keycap spring of claim 9 wherein the means for preventing the sleeve spring from sliding over the sleeve includes an area of reduced outside diameter forming a shoulder at the inside end of the sleeve.

11. The device for installing a keycap spring of claim 9 wherein the means for preventing the sleeve spring from sliding over the sleeve includes a groove in the surface of the sleeve near the inside end of the sleeve, the groove providing a recess in which an end loop of the sleeve spring rests.

12. The device for installing a keycap spring of claim 6 wherein the shaft includes an area adjacent to the handle having a diameter smaller than the diameter of the main portion of the shaft, and the means for retaining the sleeve on the shaft includes an inwardly oriented lip at the inside end of the sleeve, said lip extending inward a sufficient amount to stop the sleeve from moving toward the head of the shaft when the lip contacts the larger diameter of the main portion of the shaft.

13. The device for installing a keycap spring of claim 12 wherein the lip is formed by a bushing connected to the inside end of the sleeve.

14. The device for installing a keycap spring of claim 6 wherein the sleeve includes two longitudinal slits on opposite sides of the sleeve, and the shaft has a transverse aperture through the main portion thereof, and the means for retaining the sleeve on the shaft includes a cotter pin which is inserted through the slits in the sleeve and the aperture in the shaft.

15. The device for installing a keycap spring of claim 14 wherein the longitudinal slits have a length approximately equal to the uncompressed length of the keycap spring.

16. A keycap spring installation tool for installing a keycap spring having a bottom loop onto a mounting base in a computer keyboard, said tool comprising:

means for holding the keycap spring comprising:

a sleeve; and a magnetized shaft within the sleeve; and means for exerting downward pressure on the keycap spring sufficient to expand the bottom loop of the spring over the mounting base.

17. A method of installing a keycap spring in a computer keyboard having a vertical tube and a base for mounting the keycap spring at the bottom of the vertical tube, the method utilizing a device comprising a handle, a shaft connected to the handle, a sleeve which slides over the shaft, and a sleeve spring connected to the sleeve which slides over the shaft and fits between the sleeve and the handle, the method comprising the steps of:

inserting the keycap spring into the sleeve adjacent to a forward end of the shaft;

vertically inserting the device into the vertical tube with the forward end and the keycap spring pointing downward;

placing the keycap spring over the mounting base;

applying downward pressure to the handle of the device, causing the keycap spring to be compressed inside the sleeve between the mounting base and the forward end of the shaft; and forcing the bottom loop of the keycap spring onto the mounting base when the keycap spring is fully compressed.

18. The method of installing a keycap spring of claim 17 further comprising the step of extracting the device from the vertical tube, thereby extracting the keycap spring from the sleeve.

19. The method of installing a keycap spring of claim 18 further comprising the steps of:

determining whether a top end of the keycap spring is located in the center of the vertical tube; and upon determining that the top end of the keycap spring is not located in the center of the vertical tube:

determining a direction which the keycap spring needs to be reoriented to place the top end of the keycap spring in the center of the vertical tube;

sliding the sleeve over the installed keycap spring;

compressing the spring a second time; and applying pressure in the direction that the spring needs to be reoriented.

* * * * *